US006035549A

United States Patent [19]

Chevalier et al.

[11] Patent Number: 6,035,549

[45] Date of Patent: Mar. 14, 2000

[54] CLOSE CONTAMINATION PROTECTION DEVICE AND METHOD THEREOF FOR FOOD

[75] Inventors: Mathieu Chevalier; Christophe Chevalier, both of Garancieres, France

[73] Assignee: Ultra Propre Nutrition Industrie Recherche (U.N.I.R.), Paris, France

[21] Appl. No.: 08/945,341

[22] PCT Filed: Apr. 12, 1996

[86] PCT No.: PCT/FR96/00563

§ 371 Date: Jan. 16, 1998

§ 102(e) Date: Jan. 16, 1998

[87] PCT Pub. No.: WO96/32613

PCT Pub. Date: Oct. 17, 1996

[30] Foreign Application Priority Data

Apr. 14, 1995 [FR] France ..... 95 04526

[51] Int. Cl.[7] ..... F26B 7/00

[52] U.S. Cl. ..... 34/381; 34/403; 34/61; 34/68; 34/202; 34/227

[58] Field of Search ..... 34/389, 404, 61, 34/68, 90, 202, 218, 227, 235, 380, 381, 402, 403; 99/441, 450, 474, 475; 414/277, 940

[56] References Cited

U.S. PATENT DOCUMENTS

| | | | |
|---|---|---|---|
| 4,021,928 | 5/1977 | Johnson | 34/201 X |
| 4,750,276 | 6/1988 | Smith et al. | 34/225 X |
| 4,872,400 | 10/1989 | Brown et al. . | |
| 5,211,106 | 5/1993 | Lucke | 99/441 |
| 5,314,509 | 5/1994 | Kato et al. | 34/406 |
| 5,351,415 | 10/1994 | Brooks et al. | 34/404 |
| 5,382,127 | 1/1995 | Garric et al. | 414/217 |
| 5,411,358 | 5/1995 | Garric et al. | 414/277 |
| 5,628,121 | 5/1997 | Brooks et al. | 34/61 |
| 5,724,748 | 3/1998 | Brooks et al. | 34/90 |

FOREIGN PATENT DOCUMENTS

| | | |
|---|---|---|
| 0 510 637 A2 | 4/1992 | European Pat. Off. . |
| 0 510 637 A3 | 4/1992 | European Pat. Off. . |
| 2485700 | 6/1980 | France . |

*Primary Examiner*—Stephen Gravini
*Attorney, Agent, or Firm*—Finnegan, Henderson, Farabow, Garrett & Dunner, L.L.P.

[57] ABSTRACT

A method for closely protecting materials (10) sensitive to contamination by airborne contaminating agents and placed on a work surface (P). At least one decontaminated gas stream (1, 2) is fed from either side towards the materials in a direction substantially parallel to the work surface, and each gas stream (3) leaves the work surface in an intermediate area between the edges of the work surface and in a direction substantially perpendicular thereto. Alternatively, at least one gas stream is fed towards the materials from above the work surface at an intermediate area between the edges thereof, and in a direction substantially perpendicular thereto, and each gas stream leaves the work surface in a direction substantially parallel thereto and on either side of the materials.

24 Claims, 4 Drawing Sheets

CLOSE CONTAMINATION PROTECTION DEVICE AND METHOD THEREOF FOR FOOD

Figure 1:
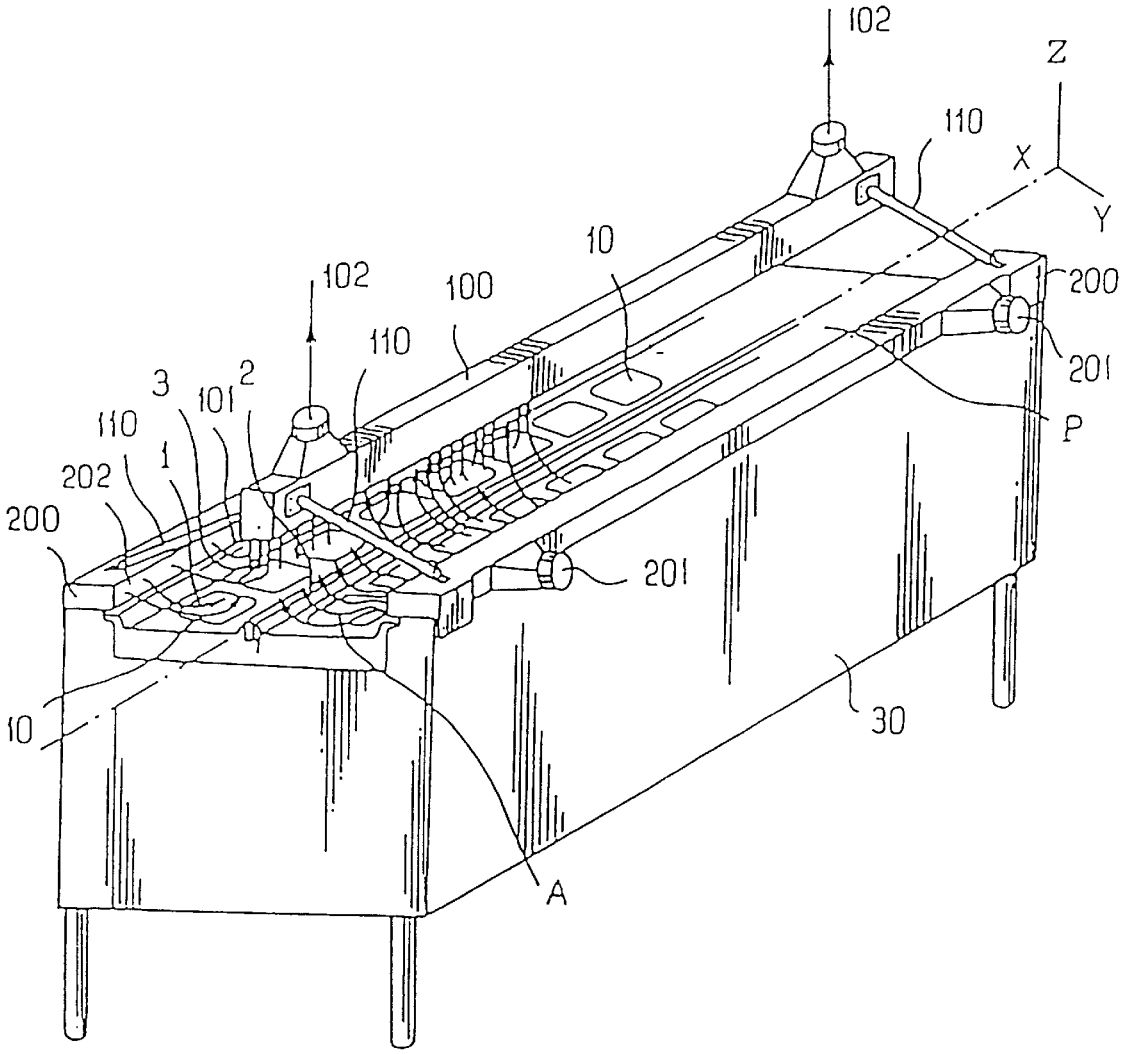

This invention relates to the close protection of a work position located in a contaminated atmosphere in a general manner, and more particularly a process and device for close protection of products sensitive to contamination by contaminating agents transported by the environment, said products being positioned on a working surface.

The problem of protecting work positions from airborne contamination arises particularly in the food processing industry, the pharmaceutical industry, and in hospital environments.

This type of problem is usually solved by placing work positions in so-called "sterile" rooms in which air is filtered and processed such that the dust level is kept below an allowable controlled limit subject to severe regulations.

Furthermore, the air that circulates in these sterile rooms is frequently regulated at a low temperature.

Personnel who need to work at this type of work position must wear special clothing that is inconvenient to put on and to wear.

Close protection of each individual work position is one solution to the disadvantages mentioned above.

However, this close protection must take account of the fact that personnel working at these work positions must take manual action on products sensitive to airborne contamination. This means that it is impossible to provide this type of close protection by a vertical flow of sterile air the same size as or larger than the position to be protected so that said station is entirely covered with sterile air, since this flow would carry the contamination on operator's hands and forearms onto the products.

Within this context, the invention proposes a new process for close protection of products sensitive to airborne contamination, these products being positioned on a working surface, by which at least one stream of decontaminated gas is blown on each side of said products, approximately parallel to said working surface, towards said products, each gas stream being evacuated from the working surface starting from a median region located between the edges of said working surface along a direction approximately perpendicular to said working surface, or conversely at least one stream of decontaminated gas is blown above the working surface in a median region of the working surface located between the edges of this working surface along a direction approximately perpendicular to said working surface towards said products, each gas stream being evacuated from the working surface along a direction approximately parallel to said working surface on each side of said products.

Thus, products positioned on the working surface are isolated from the contaminated environment by a flow of decontaminated gas surrounding them, and which flows either vertically downwards towards the working surface and then transversely towards the edges of said working surface, or starting from the edges of said working surface transversely towards said products, and then vertically upwards from said working surface.

The contamination introduced by personnel working on sensitive products positioned on the working surface is then automatically drawn by the decontaminated gas flow along one of the paths, away from said working surface without this contamination reaching said products.

Furthermore, note that the dimensions of each flow stream are optimized.

According to one embodiment of the process according to the invention, products are laid out along a horizontal direction X, and two decontaminated gas streams are directed towards said products, from each side of said X direction along a Y direction approximately transverse to said X direction, said gas streams being evacuated along a vertical Z direction approximately perpendicular to said X direction, or conversely a decontaminated gas stream is directed towards said products along the vertical Z direction approximately perpendicular to said X direction, said gas stream being evacuated along the Y direction approximately transverse to said X direction on each side of said X direction.

According to a particularly beneficial characteristic of the process according to the invention, each gas stream is sucked in above said products, or conversely each gas stream is sucked in on each side of said products.

Thus, by sucking in the sterile gas streams transporting contaminated particles, heavier contaminated particles (if any) are prevented from falling on products.

According to one beneficial characteristic of this embodiment of the process according to the invention, the products are aligned along a conveyor belt moving along the X direction, and two decontaminated gas streams are directed from the longitudinal edges of said belt towards the middle of said conveyor belt, and said gas streams are sucked in along the plane of symmetry of said belt, or conversely a decontaminated gas stream is directed along the plane of symmetry of the conveyor belt towards the belt, and the decontaminated gas streams are sucked towards the longitudinal edges of said conveyor belt.

The process according to the invention may be improved to adapt it to working surfaces or conveyor belts which are not connected to the frame in an airtight manner. According to this variant, a decontaminated gas stream is directed on the sides and under the working surface or the conveyor belt such that the working surface or conveyor belt is surrounded by protection streams.

In the case of a conveyor belt in which only the belt drive chain creates a lack of air tightness such that contaminated air may be drawn in, the process according to the invention consists of blocking induction by deviating part of each decontaminated gas stream approximately parallel to the working surface, described above, towards the edges of said belt.

The close protection device according to the invention comprises blower means capable of producing at least a decontaminated gas stream flowing towards the products on each side of the products, each decontaminated gas stream following a path oriented firstly approximately parallel to said working surface such that each decontaminated gas stream blows on said products and is then directed from a median region in the working surface located between the edges of the working surface, approximately perpendicular to said working surface, or conversely directed into a median region of the working surface located between the edges of the working surface towards products approximately parallel to said working surface, and then oriented approximately perpendicular to said working surface on each side of said products.

According to one characteristic of the device according to the invention, suction means may be provided to intake the blown decontaminated gas.

According to a first embodiment of the protection device according to this invention, the blower means include at least one gas inlet and at least two decontaminated gas outlets opposite each other, each gas outlet being in the form of a slit positioned on a side of the working surface and extending longitudinally in the X product positioning direction.

According to one beneficial characteristic of this first embodiment of the device according to the invention, the suction means include a suction opening placed above the working surface facing said products, in a median region located between the two decontaminated gas outlets in the blower device.

According to a second embodiment of the protection device according to this invention, the blower means include a gas inlet and a decontaminated gas outlet positioned facing the products above the working surface in a median region of said working surface.

According to this embodiment, suction means comprise two intake openings placed facing each other, each intake opening being in the form of a slit positioned on one side of said working surface and extending longitudinally to said X direction.

The protection device may be improved to adapt it to working surfaces that are not airtight.

According to a first variant, the device comprises additional blower means including at least one gas inlet that may be the inlet to the main blower means, and at least two decontaminated gas outlets facing each other, each gas outlet being in the form of a slit positioned at the edge of and under the working surface and extending longitudinally to the X product positioning direction. Gas streams are evacuated along the plane of symmetry perpendicular to the working surface.

According to a second variant, the device comprises a lower duct through which a gas stream circulates along the lower surface and along the edges of the working surface or conveyor belt.

According to another variant adapted to a conveyor belt in which all that creates a lack of air tightness and enables induction of contaminated air is the belt drive chain, the blower means include at least one gas inlet and at least two decontaminated gas outlets facing each other, each gas outlet being in the form of a slit positioned on one side of the working surface and extending longitudinally to the X product positioning direction and are provided with an aerodynamic means of deviating part of the decontaminated gas stream along the edges of said conveyor belt in a direction perpendicular to the plane of the conveyor belt.

The following description with reference to the attached drawings given as non-restrictive examples, will give a clear idea of the scope of the invention, and particularly how it may be made.

Figure 2:
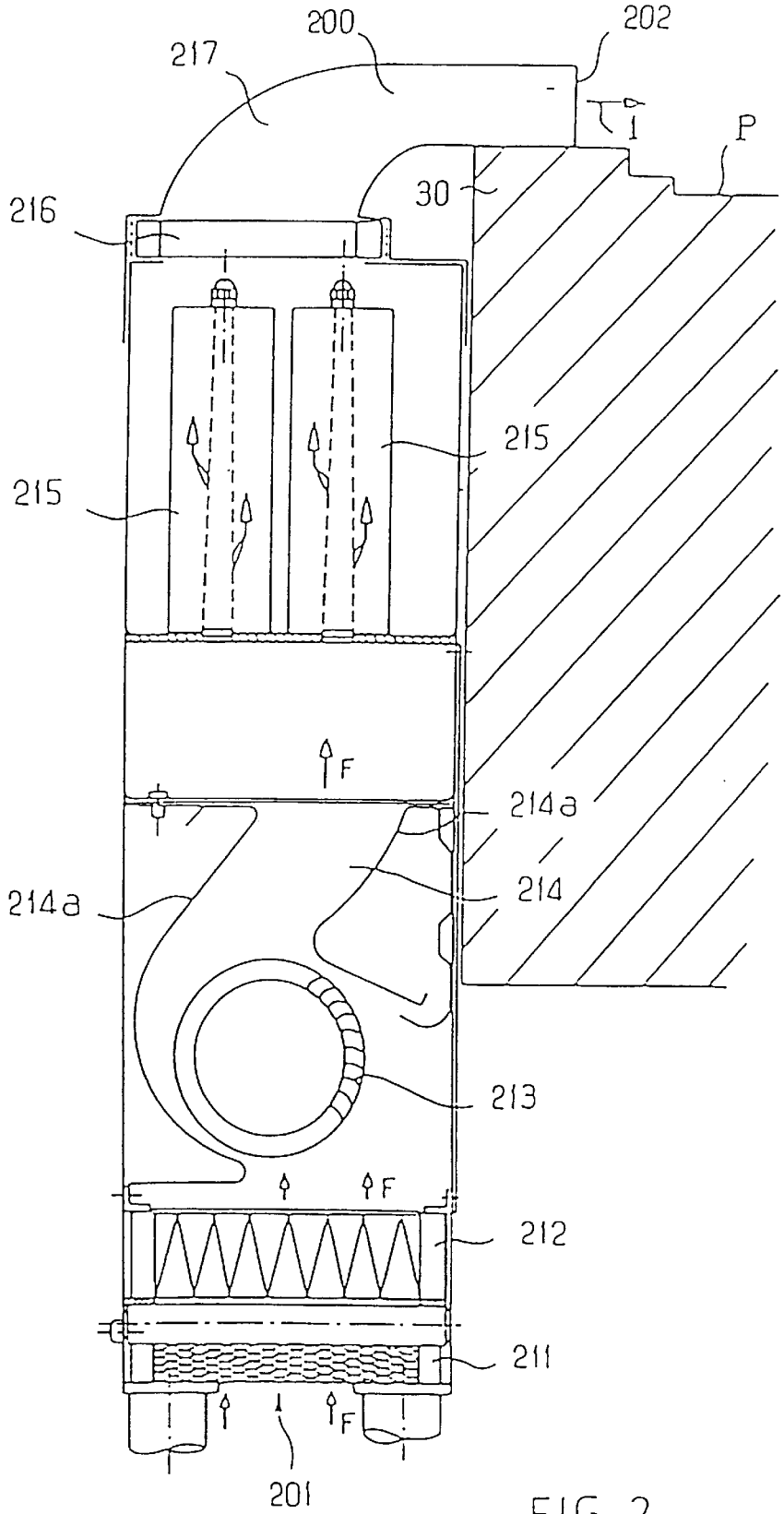
Figure 3:
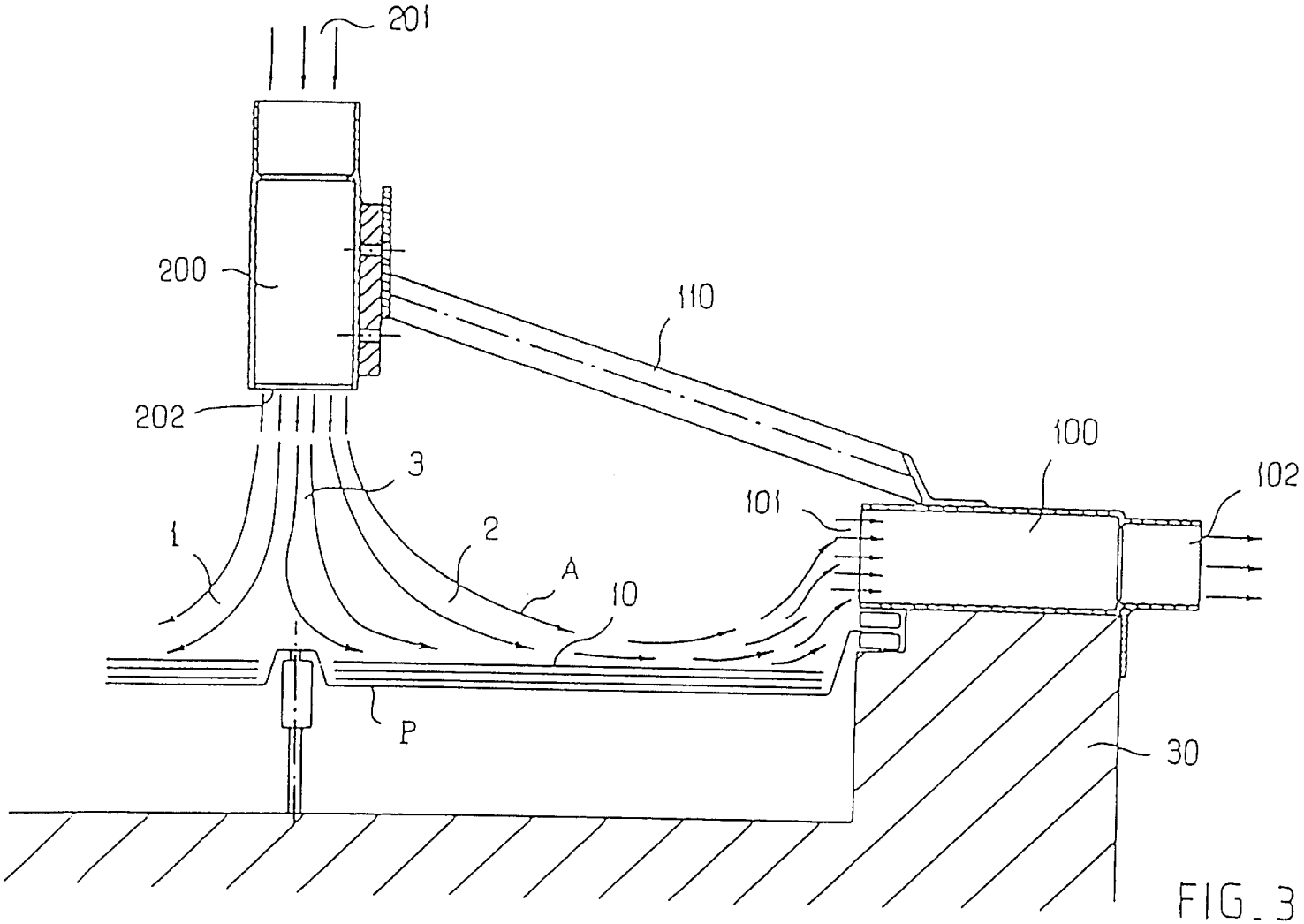
Figure 4:
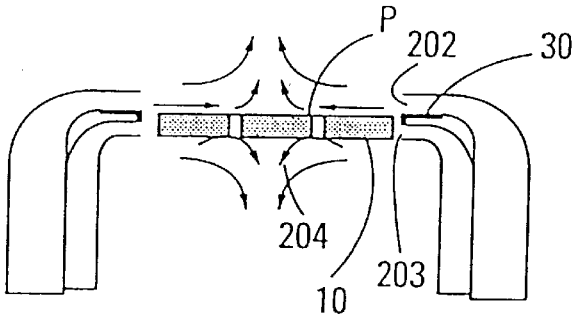
Figure 5:
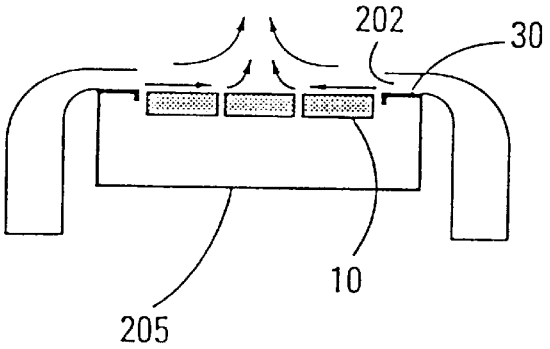
Figure 6:
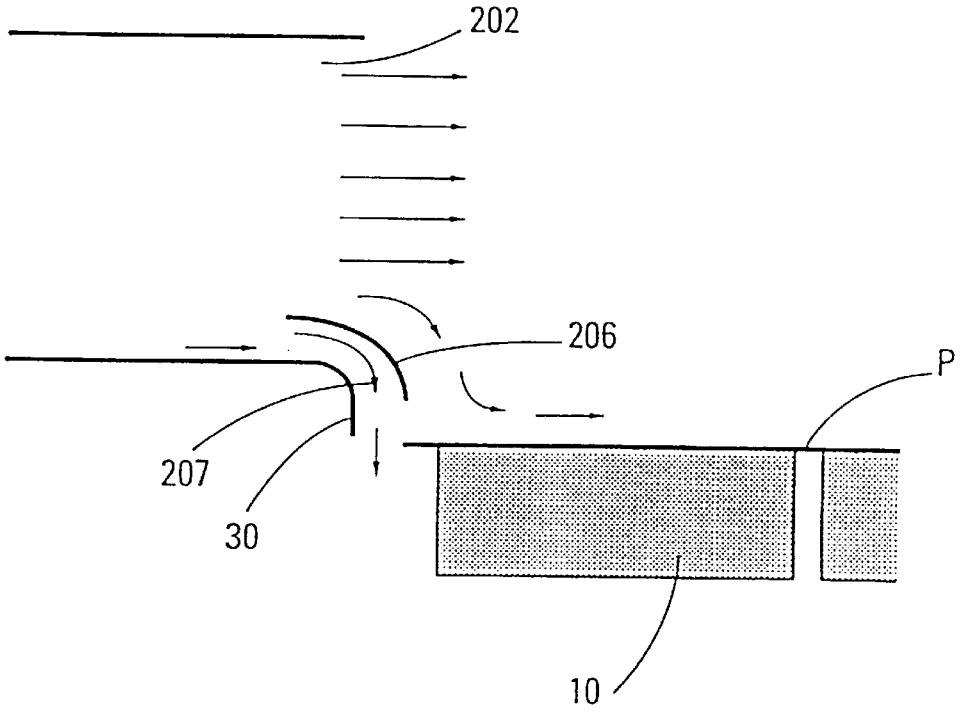

On the attached drawings:

FIG. 1 is a diagrammatic perspective view of a close protection device according to the invention installed on a work position, FIG. 2 is a vertical section of a diagrammatic view through part of a blower device forming part of the close protection device according to the invention, FIG. 3 is a diagrammatic front view of a variant of the embodiment of the close protection device in FIG. 1, FIG. 4 is a diagrammatic sectional view of a variant of an embodiment of the protection device fitted with auxiliary blower means, FIG. 5 is a diagrammatic sectional view of another variant of an embodiment of the protection device fitted with auxiliary blower means, FIG. 6 is a diagrammatic sectional view of another variant of an embodiment of the protection device fitted with an aerodynamic means of deviating the horizontal gas stream.

FIG. 1 shows a work position comprising a frame 30 supporting a working surface P on which products 10 sensitive to airborne contamination, for example food products, are laid out in a line along a horizontal direction X. The working surface P may consist of a conveyor belt capable of transporting said products 10 along the X direction.

Personnel who need to work on these sensitive products 10 may be positioned on each side of the frame 30 and work on products 10 from above.

A close protection device for products 10 is installed on frame 30.

This device includes a decontaminated gas blower device 200 containing two inputs 201 of a decontaminated gas, for example sterile air, on each longitudinal side (only one side of which is visible) of said working surface P. Obviously, a larger number of decontaminated gas inlets, not shown, could be provided. These inlets 201 are positioned at a distance from each other along each longitudinal side of said working surface P and lead into a containment provided with a sterile air outlet 202 in the form of a slit extending longitudinally to said X direction along the entire length of the side of the working surface P. The two blower device outlet slits 202 are located at the working surface P, on which products 10 are placed, facing each other.

Furthermore, the device shown in FIG. 1 comprises a blown decontaminated gas suction device 100 including an intake opening 101 in the form of a slit, extending longitudinally to the X product 10 positioning direction, and located above the working surface P, facing said products in a median region of the working surface located between the two outlet slits 202 of the blower device 200.

The suction device 100 in this case comprises two air outlets 102 located above the intake opening 101 such that they can evacuate drawn in gas flow 102 upwards. These two gas outlets 102 are positioned at a distance from each other close to the edges at the ends, and said intake opening 101. Obviously, a larger number of gas outlets could be provided in a variant, not shown.

The suction device 100 is mounted fixed to the blower device 200 by means of support arms 110 such that it is suspended above the working surface P. In this case, four support arms 110 are provided laid out in pairs, each pair of support arms 110 being positioned on each side of the intake opening 101 and being fixed firstly to the suction device 100 and secondly to a blower device compartment 200.

This type of device works as follows.

A sterile air flow enters the blower device 200 through inlets 201 and is distributed onto products through outlet slits 202 in said blower device such that the sterile air outlet from said slits follows a path A directed mainly parallel to said working surface P transverse to said direction X. Sterile air outlet from these slits 202 then blows over products 10 located on the working surface P. At the same time, the suction device 100 sucks in sterile air outlet from the blower device outlet slits 202, through its intake opening 101. Air outlet from the suction device outlet slits 202 is therefore drawn in a median region of the working surface P such that the path A of the sterile air flow is deviated upwards perpendicular to said working surface P on which the products 10 are positioned. Two main sterile air streams 1, 2 are outlet from said outlet slits 202. These two streams 1, 2 are directed towards each other and come together in a median region of the working surface to form a flow stream upwards perpendicular to said working surface P, towards the intake opening 101.

Obviously, it would be possible to eliminate the suction device according to one variant of the device in FIG. 1, not shown. In this case, the sterile air jets outlet from outlet slits meet face to face in the median region of the working surface, which has the effect of naturally creating a central stream that is evacuated vertically upwards perpendicular to said X direction of said working surface, and carrying contaminated particles.

FIG. 3 shows another variant of an embodiment of the device in FIG. 1.

According to this variant, the decontaminated gas blower device 200 is installed above the working surface P and the suction device is positioned on frame along the longitudinal sides of said working surface P longitudinal to the X positioning direction of products 10.

The blower device 200 is installed rigidly attached to the suction device 100 by means of the same support arm system 110 already described above.

The blower device 200 includes a gas inlet 201 and a decontaminated gas outlet 202. This sterile gas outlet 202 is in the form of a slit extending longitudinally to the X direction above the P surface facing said products 10. The suction device 100 comprises two intake openings 101 in the form of two slits 101 extending along the longitudinal sides of aid working surface P. These suction openings 101 are connected to air outlets 102.

This type of variant operates as follows.

The blower device 200 produces a decontaminated gas stream 3 through its outlet 202 towards the products 10 located in surface P. This decontaminated gas stream 3 follows a path A directed perpendicular to said surface P. When this decontaminated gas stream 3 comes into contact with said surface P, it separates into two streams 1, 2 which follow path A oriented mainly parallel to said surface P and transverse to the X direction along which said products 10 are positioned in opposite directions such that the streams of sterile air come into contact with the products 10 positioned on surface P. These decontaminated gas flow streams 1, 2 are drawn in through intake openings 101 in the suction device 100 such that the gas is evacuated on the sides of the working surface P.

Here again, it would obviously be possible to consider a variant of the device, not shown in FIG. 3, which does not include the suction device. In this case, the two flow streams parallel to the working surface would be evacuated naturally at the edges of surface P.

FIG. 2 shows a vertical section of a detailed view inside an embodiment of part of a blower device forming part of an anti-microbial protection device according to the invention. This embodiment of the blower device is a variant of the embodiment shown in FIG. 1.

With reference to FIG. 2, the blower device comprises a gas inlet 201 on each side of the working surface P positioned at the sides of the working surface P below said surface P such that the gas entering said device is transported along a vertical path upwards towards a slit-shaped outlet 202 located at the same level as said surface P. This blower device 200 includes a grease filter 211 in a box that extends vertically on the side of the frame 30 between the inlet 201 and the outlet 202, this grease filter extending horizontally over the entire width of the box over the vertical direction F of the gas flow inlet into said blower device, and then into a preliminary filter 212 which also extends over the entire width of the box, a fan 213 to transport the filtered gas towards the top of the blower device 200. This fan 213 is placed in a labyrinth path 214 formed by gas flow deflectors 214*a* such that the filtered gas flow at the exit from this labyrinth path is vertically upwards along direction F in the blower device 200. A pair of absolute filters 215 is placed in parallel above the labyrinth path 214, the efficiency of which may beneficially be equal to or greater than the efficiency of the very high efficiency filter (normalized filter). These filters 215 extend along said vertical direction F. An anti-turbulence grill is placed in a horizontal direction above the absolute filters 215 in order to reduce the turbulence of the sterile air flow that leads into compartment 217 with an elbow path, and converging in order to further reduce the turbulence, leading the decontaminated gas flow to the outlet in the shape of a slit 202 in a direction approximately transverse to the X direction.

It is useful to reduce the turbulent diffusion speed (directed perpendicular to the flow direction) of the contaminated particles drawn in by the gas flow in order to prevent them from reaching the products.

Since this turbulent diffusion speed is closely related to the turbulence ratio, and to the size of the vortices present in the flow, the turbulence ratio has to be reduced in order to reduce the diffusion speed.

FIG. 4 diagrammatically shows work position P on which products 10 sensitive to airborne contamination are placed in a line along the horizontal X direction. The working surface is not connected to the rest of the frame 30 in an airtight manner. Consequently, contaminated air induction through the space left free between the working surface and the frame would be possible.

Two additional sterile air outlets 203 are provided in the form of a slit extending longitudinally to said direction X along the entire length at the edges of the working surface P and under the working surface. An air outlet 202 identical to that described in FIG. 1 and FIG. 2 is also provided.

The gas stream 204 is distributed on each side of the working surface along a path going around the edges of said surface and then passing in contact with the lower surface of said surface until the longitudinal median line of said surface where the gas streams join together and then move along a direction perpendicular to said surface.

In FIG. 5, which shows the same work position P not connected to frame 30 as shown in FIG. 4, a U-shaped section 205 fixed under the frame forms a duct leading a sterile air current at a slight overpressure under the work position P preventing any induction of contaminated air through free spaces left due to the lack of air tightness between the frame and the working surface.

In FIG. 6, the device includes a conveyor belt P, in which the drive chain (not shown) causes a lack of air tightness with frame 30. The outlets 202 are fitted in the lower area with an elbow 206 creating a duct 207 which deviates part of the sterile air flow towards the edges of the conveyor belt, consequently preventing any induction of contaminated air.

Obviously, this invention is in no way limited to the embodiments described and shown in the figures, but an expert in the field will be able to create variants conform with its spirit.

We claim:

1. A process for the protection of food products from contamination by environmental agents, said process comprising directing at least one stream of a decontaminated gas towards each side of food products placed on a working surface, wherein the gas stream runs approximately parallel to said working surface and wherein each gas stream is evacuated from the working surface from a median region located above the working surface and between the edges of the working surface along a direction approximately perpendicular to said working surface, or conversely directing at least one gas stream above the working surface in a median region of said working surface and between its edges, along a direction approximately perpendicular to said working surface towards said food products, each said stream of decontaminated gas being evacuated from the working surface along a direction approximately parallel to said working surface on each side of said food products.

2. The process according to claim 1, wherein the food products are laid out along a horizontal X direction, and two decontaminated gas streams are directed on each side of said X direction, along a Y direction approximately transverse to said X direction, towards said food products, and said gas streams are evacuated along a vertical Z direction approximately perpendicular to said X direction, or conversely wherein a decontaminated gas stream is directed towards said food products along the vertical Z direction approximately perpendicular to said X direction, said stream of decontaminated gas being evacuated along the Y direction approximately transverse to said X direction, on each side of said X direction.

3. The process according to claim 1, wherein each gas stream is drawn in by suction above said food products, or conversely wherein each stream of decontaminated gas is drawn in by suction on each side of said food products.

4. The process according to claim 2, wherein the food products are aligned on a conveyor belt, which moves along the X direction, and two streams of decontaminated gas are directed from the longitudinal edges of said belt towards the middle of said conveyor belt, and a gas stream is drawn in by suction in the plane of symmetry of said conveyor belt, or conversely wherein a decontaminated gas stream is directed in the plane of symmetry of said conveyor belt towards said conveyor belt, and the streams of decontaminated gas are drawn in by suction towards the longitudinal sides of said conveyor belt.

5. The process according to claim 4, wherein the working surface or the conveyor belt is not connected to a frame in an airtight manner, and wherein an additional decontaminated gas stream is directed along the sides and underneath the working surface such that the working surface is surrounded by streams of decontaminated gas located above the working surface and by the additional decontaminated gas stream.

6. The process according to claim 5, wherein an air tight defect is created between the frame and the conveyor belt by the drive chain of said duct, and contaminated air induction is blocked by deviating part of each decontaminated gas stream towards the edges of said belt.

7. A device for protection of food products sensitive to contamination by environmental agents, wherein the device comprises a working surface on which said food products are placed and a blower means capable of producing at least one stream of decontaminated gas on each side of said food products towards the food products, wherein each decontaminated gas stream flows approximately parallel to the working surface, such that each decontaminated gas stream passes in contact with said food products and is then directed from a median region of the working surface located between the edges of the working surface, approximately perpendicular to said working surface or conversely wherein each decontaminated gas stream flows towards a median region of the working surface located between the edges of this working surface, approximately perpendicular to said working surface, towards said food products, and then approximately parallel to said working surface on each side of said food products.

8. The device according to claim 7, farther including a suction means.

9. The device according to claim 8, in which the blower means or suction means are fixed to the suction means or the blower means.

10. The device according to claim 8, wherein the food products are placed along an X direction, and wherein the blower means are capable of blowing two decontaminated gas streams on each side of said X direction along which food products are positioned, the two gas streams being directed towards each other along a Y direction transverse to said X direction, towards said food products.

11. The device according to claim 10, wherein the blower means comprise at least one gas inlet and at least two decontaminated gas outlets facing each other, and wherein each gas outlet comprises a slit placed on one side of the working surface and extending longitudinally to the X direction along which food products are positioned.

12. The device according to claim 10, wherein the suction means are capable of drawing in the two gas streams to form a common stream above the working surface on which the food products are positioned, along a Z direction perpendicular to said surface.

13. The device according to claim 12, wherein the suction means comprise an intake opening placed above the surface facing said food products in a median region between the two decontaminated gas outlets from the blower means.

14. The device according to claim 8, wherein the food products are positioned along an X direction, and the blower means are capable of blowing a decontaminated gas stream towards the food products, above the working surface on which the food products are positioned.

15. The device according to claim 14, wherein the blower means comprise a decontaminated gas inlet and an outlet facing the food products above the working surface in a median region of said working surface.

16. The device according to claim 14, wherein the suction means are capable of separating the gas stream that is blown toward the food products from above the working surface into two gas streams, the two gas streams being directed transverse to said X direction along opposite directions.

17. The device according to claim 16, wherein the suction means comprise two intake openings that face each other, and wherein each intake opening comprises a slit positioned on one side of the working surface that extends longitudinally to said X direction.

18. The device according to one of claims 11 or 15, wherein said blower means comprise, in sequence, an air filtering means, and means for transporting the gas from the inlet towards the outlet, between each decontaminated gas inlet and outlet.

19. The device according to claim 18, wherein the blower means also include anti-turbulence means proximate to said decontaminated gas outlet.

20. The device according to claim 18, wherein the air filtering means comprise at least one filter with an efficiency equal to or greater than a very high efficiency filter, and wherein the transport means comprise a fan.

21. The device according to claim 7, further including an additional blower means having at least one gas inlet that may be the same as the inlet used for the main blower means and at least two decontaminated gas outlets facing each other, wherein each gas outlet comprises a slit positioned underneath and on the edge of the working surface, and wherein the outlet extends longitudinally in the X direction along which food products are positioned, and the gas streams are evacuated in a plane of symmetry perpendicular to the working surface.

22. The device according to claim 7, flirter including a lower duct capable of circulating a gas stream underneath and along the edges of the working surface.

23. The device according to claim 7, wherein the food products are aligned on a conveyor belt, a drive chain of which creates a lack of air tightness enabling induction of contaminated air into the device, and wherein the blower means include at least one decontaminated gas inlet and at least two decontaminated gas outlets facing each other, each gas outlet comprising a slit positioned on one side of the working surface and extending longitudinally in the X direction along which food products are positioned and equipped with an aerodynamic means for deviating part of the decontaminated gas stream along the edges of said conveyor belt in a direction perpendicular to the plane of the conveyor belt.

24. The device according to claim 23, wherein the aerodynamic means is an elbow-shaped divider located in the lower area of the gas outlets, deviating part of the sterile air flow towards the edges of the conveyor belt.

* * * * *